US007004751B2

(12) United States Patent
Malloy et al.

(10) Patent No.: US 7,004,751 B2
(45) Date of Patent: Feb. 28, 2006

(54) GAS BURNER ASSEMBLIES, METHODS FOR ASSEMBLING, AND GAS FIRED APPLIANCES EMPLOYING SAME

(75) Inventors: Shawn T. Malloy, Gorham, ME (US); Roger W. Purinton, Raymond, ME (US); Dana M. Johnson, Buxton, ME (US); Anthony R. Labelle, Biddeford, ME (US); Shane L. Spencer, Windham, ME (US)

(73) Assignee: Jotul North America, Inc., Portland, ME (US)

( * ) Notice: Subject to any disclaimer, the term of this patent is extended or adjusted under 35 U.S.C. 154(b) by 0 days.

(21) Appl. No.: 10/744,515

(22) Filed: Dec. 23, 2003

(65) Prior Publication Data

US 2005/0136368 A1 Jun. 23, 2005

(51) Int. Cl.
*F23D 14/46* (2006.01)

(52) U.S. Cl. ..... 431/154; 431/326; 431/354; 126/39 E; 126/512; 29/243.5; 29/513; 403/329

(58) Field of Classification Search ..... 431/354, 431/125, 154, 326, 328, 329; 126/39 E, 126/512; 29/513, 509, 505, 463, 243.5; 239/55, 56; 72/379.2, 379.4, 324–341; 403/326, 329

See application file for complete search history.

(56) References Cited

U.S. PATENT DOCUMENTS 1,415,965 A * 5/1922 Waterman ..... 126/248
1,761,953 A * 6/1930 Zubaty ..... 73/431
2,164,634 A * 7/1939 Barrett ..... 403/274
2,701,318 A * 2/1955 Feiertag ..... 310/258
3,061,338 A 10/1962 Clark ..... 285/202
3,158,930 A * 12/1964 Wesstrom et al. ..... 29/510
3,664,591 A * 5/1972 Stohrer, Jr. et al. ..... 239/552
3,738,577 A * 6/1973 Blanzy et al. ..... 239/568
4,055,132 A * 10/1977 Stohrer et al. ..... 72/326
4,331,201 A * 5/1982 Hesse ..... 165/153
4,531,578 A * 7/1985 Stay et al. ..... 165/175
4,532,578 A * 7/1985 Gaden et al. ..... 362/549
4,571,942 A * 2/1986 Carre et al. ..... 60/547.1
4,583,516 A * 4/1986 Patterson ..... 126/531
4,600,051 A * 7/1986 Wehrman ..... 165/149
4,822,060 A * 4/1989 Moyer et al. ..... 277/640
4,881,595 A * 11/1989 Damsohn et al. ..... 165/173
4,886,044 A 12/1989 Best ..... 126/39
4,906,180 A * 3/1990 Dvorak ..... 431/328
5,074,024 A * 12/1991 Gautier ..... 29/451

(Continued)

*Primary Examiner*—Ehud Gartenberg
*Assistant Examiner*—James G. Barrow
(74) *Attorney, Agent, or Firm*—Heslin Rothenberg Farley & Mesiti P.C.

(57) ABSTRACT

A gas burner assembly includes in one embodiment a top plate having at least one port for discharging fuel and a downwardly-depending, peripheral edge having a plurality of spaced-apart slots, and a bottom base having a peripheral edge disposed within the downwardly-depending peripheral edge of the top plate. A gasket is disposed between the base and the plate. A venturi tube is attached to the base with a tube holder. The plate is attachable to the base by displacing and/or expanding a portion of the downwardly-depending, peripheral edge adjacent the slots to form a plurality of spaced-apart, inwardly-extending tabs disposed under the peripheral edge of the base. Methods for assembling and gas fired appliances employing gas burner assemblies are also disclosed. Further, attachment means and methods for attaching a first member to a second member using such displaceable and/or expandable tabs are also disclosed.

35 Claims, 6 Drawing Sheets

U.S. PATENT DOCUMENTS 5,204,075 A * 4/1993 Jain et al. ..... 423/219
5,297,471 A * 3/1994 Boehm et al. ..... 92/98 R
5,359,923 A 11/1994 Boswell ..... 99/340
5,372,269 A 12/1994 Sutton et al. ..... 220/62
5,471,973 A * 12/1995 Wilhoite ..... 126/200
5,571,008 A * 11/1996 Richardson et al. ..... 431/125
5,588,667 A 12/1996 Emambakhsh et al. .... 280/28.2
5,806,412 A 9/1998 Bedford et al. ..... 99/447
5,846,071 A 12/1998 Sigler ..... 431/266
5,960,785 A * 10/1999 Byrne et al. ..... 126/200
6,006,742 A * 12/1999 Jamieson et al. ..... 126/512
6,045,356 A * 4/2000 Hunter et al. ..... 431/354
6,095,794 A * 8/2000 Jamieson et al. ..... 431/125
6,244,263 B1 6/2001 Schlosser et al. ..... 126/39 R
6,443,726 B1 9/2002 Atemboski et al. ..... 431/125
6,561,179 B1 5/2003 Brake et al. ..... 126/41 R

* cited by examiner

GAS BURNER ASSEMBLIES, METHODS FOR ASSEMBLING, AND GAS FIRED APPLIANCES EMPLOYING SAME

FIELD OF THE INVENTION

This invention relates generally to gas fired appliances, and more specifically, to gas burner assemblies for gas fired appliances.

BACKGROUND OF THE INVENTION

Gas fired appliances such as vented gas fireplace heaters have gained widespread popularity recently. Typically, a vented gas fireplace heater includes a housing having a glass front, a gas burner assembly, and a plurality of ceramic logs. The vented gas fireplace heater can be a stand-alone unit with legs, and/or be installed in an existing fireplace.

Conventionally, the gas burner assembly includes a flat stainless steel top plate connected to a cast iron bottom base with bolts. Assembly requires drilling vertically-extending holes in the cast iron bottom base which holes are then tapped to form screw threads for receiving the bolts. The stainless steel top plate requires drilling vertically-extending holes which correspond and align with the threaded holes installed in the cast iron bottom base. Thereafter, the bolts are typically manually tightened to attach the stainless steel top plate to the cast iron bottom base. Other techniques for assembling a gas burner assembly include attaching a flat ceramic top plate to the bottom base using an adhesive such as a high temperature resistant silicone adhesive.

There is a need for further gas burner assemblies and methods for assembly of gas burner assemblies for use in gas fired appliances.

SUMMARY OF THE INVENTION

In a first aspect, the present invention provides a gas burner assembly which includes a top plate having at least one port for discharging fuel and a downwardly-depending, peripheral edge having a plurality of spaced-apart slots, a bottom base having a peripheral edge disposed within the downwardly-depending, peripheral edge of the top plate, and wherein the top plate is attached to the bottom base by displacing a portion of the downwardly-depending, peripheral edge adjacent to the slots to form a plurality of spaced-apart, inwardly-extending tabs disposed under the peripheral edge of the bottom base.

In a second aspect, the present invention provides a gas burner assembly which includes a top plate having at least one port for discharging fuel and a downwardly-depending, peripheral edge having a plurality of spaced-apart slots, a bottom base having a peripheral edge disposed within the downwardly-depending, peripheral edge of the top plate, a gasket disposed between the bottom base and the top plate, a venturi tube assembly, and a tube holder for attaching the venture tube assembly to the bottom base. Additional features of the gas burner assembly may include the distance between adjacent slots being greater than a length of the slots. The top plate may be attached to the bottom base by expanding a portion of the downwardly-depending, peripheral edge under the slots to form a plurality of spaced-apart, inwardly-extending tabs disposed under the peripheral edge of the bottom base. The gasket and the bottom base are sandwiched between a bottom surface of the top plate and the tabs and operable to maintain a gas tight seal between the top plate, the bottom base, and the gasket.

In a third aspect, the present invention provides gas fired appliances which include a housing, and the above-described gas burner assemblies. At least one ceramic log may also be disposed in the gas fired appliances.

In a fourth aspect, the present invention provides a method for assembling a gas burner assembly in which the method includes positioning a bottom base having a peripheral edge within a top plate having at least one port and having a downwardly-depending, peripheral edge with spaced-apart slots adjacent to the periphery of the top plate. Portions of the downwardly-depending, peripheral edge of the top plate adjacent to the slots are displaced to form a plurality of spaced-apart tabs under the peripheral edge of the bottom base to attach the top plate to the bottom base.

In a fifth aspect, the present invention provides an attachment means which includes a first member having a downwardly-depending, peripheral edge having a plurality of spaced-apart slots, a second member having a peripheral edge disposed within the downwardly-depending, peripheral edge of the first member, and wherein the first member is attached to the second member by displacing a portion of the downwardly-depending, peripheral edge under the slots to form a plurality of spaced-apart, inwardly-extending tabs disposed under the peripheral edge of the second member, and the first member and the second member are formed from different materials having different rates of thermal expansion. The first member may be attached to the second member by expanding a portion of the downwardly-depending, peripheral edge under the slots to form a plurality of spaced-apart, inwardly-extending tabs disposed under the peripheral edge of the second member. A gasket may be disposed between the first member and the second member adjacent to the peripheral edge.

In a sixth aspect, the present invention provides a method for attaching a first member to a second member. The method includes positioning the second member having a peripheral edge within the first member having a downwardly-depending, peripheral edge with spaced-apart slots adjacent to the periphery of the first member, and expanding portions of the downwardly-depending, peripheral edge of the first member adjacent to the slots to form a plurality of spaced-apart tabs under the peripheral edge of the bottom base to attach the first member to the bottom base.

BRIEF DESCRIPTION OF THE DRAWINGS

The subject matter which is regarded as the invention is particularly pointed out and distinctly claimed in the concluding portion of the specification. The invention, however, may best be understood by reference to the following detailed description of various embodiments and the accompanying drawings in which:

DETAILED DESCRIPTION OF THE INVENTION

Figure 1:
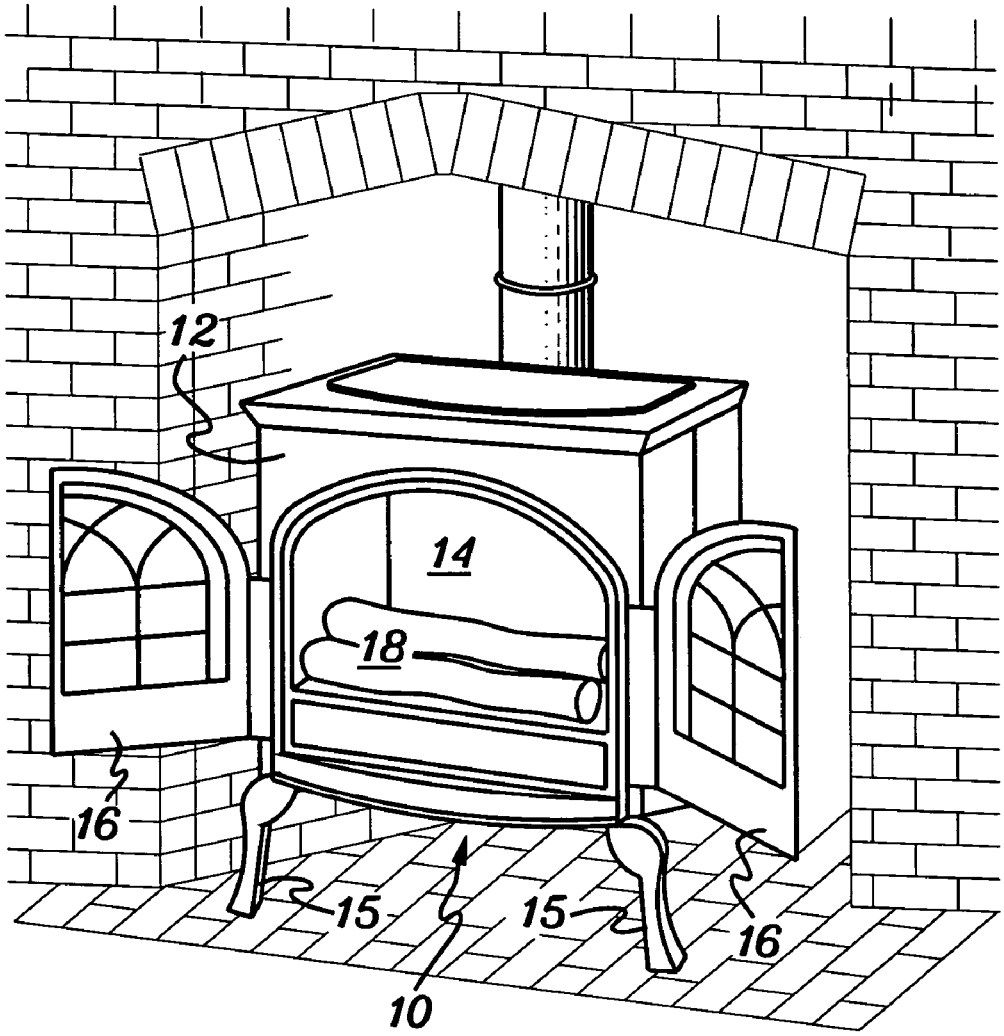
FIG. 1 is a perspective view of a gas fired appliance such as a vented gas fireplace heater employing a gas burner assembly (not shown in FIG. 1) in accordance with the present invention.

FIG. 1 illustrates one embodiment of a gas fired appliance such as a vented gas fireplace heater 10 in accordance with the present invention. Vented gas fireplace heater 10 generally includes a housing 12 having a chamber 14 therein and supported by a plurality of feet 15, a pair of doors 16 having glass panels, a gas burner assembly (not shown in FIG. 1) disposed in chamber 14, and at least one ceramic log 18 disposed in chamber 14 above the gas burner assembly.

Figure 2:
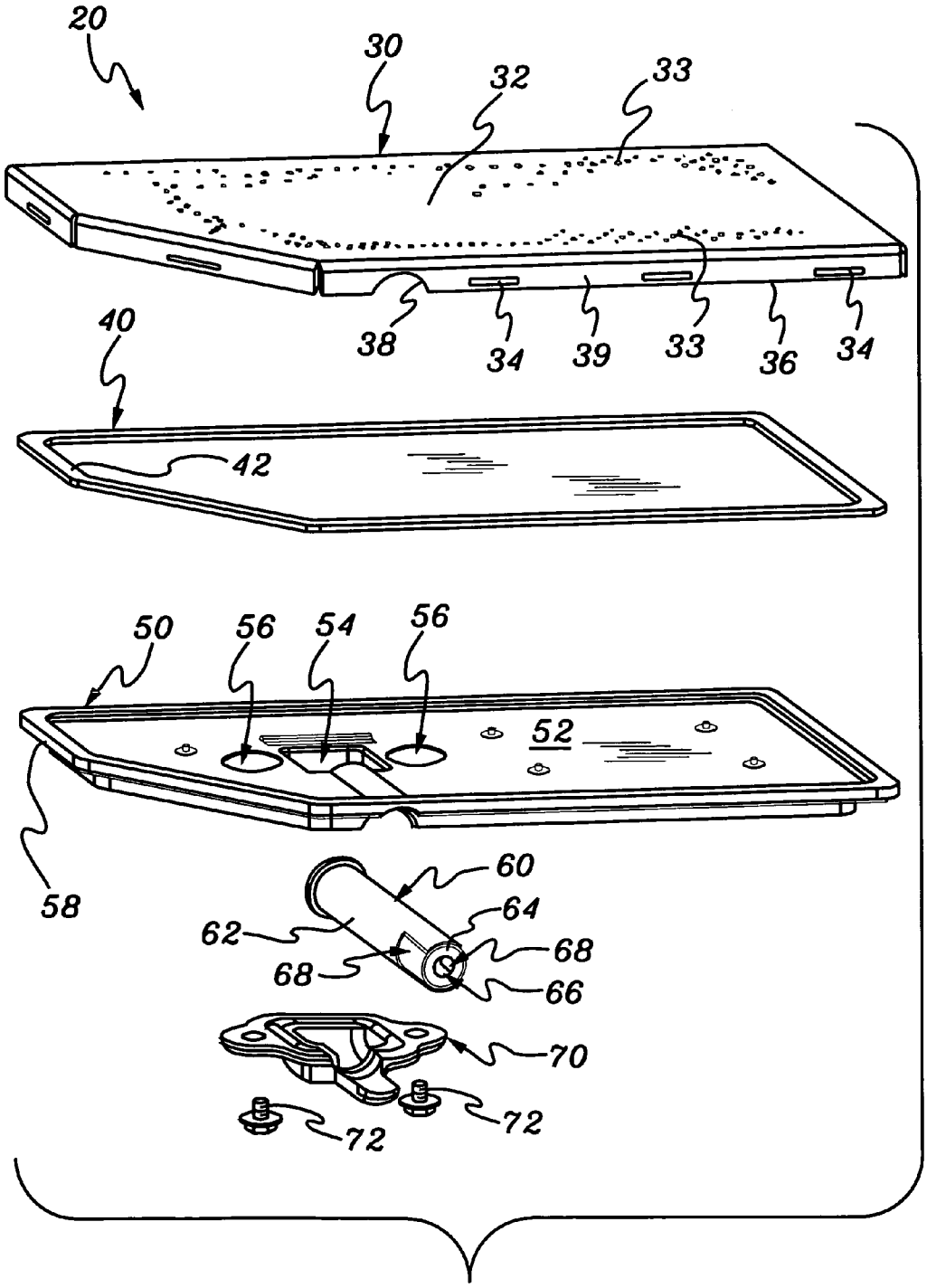
FIG. 2 is an exploded perspective view of the gas burner assembly of FIG. 1 in accordance with the present invention prior to assembly.

FIG. 2 illustrates an exploded view of a gas burner assembly 20 in accordance in the present invention prior to assembly, and which after assembly, may be installed in vented gas fireplace heater 10 (FIG. 1). Gas burner assembly 20 generally includes a top plate 30, a gasket 40, a bottom base 50, a venturi tube 60, and a tube holder 70.

As explained in greater detail below, the attachment technique of the present invention incorporates the use of tabs, eliminates the use of bolts, compensates for the use of materials with different rates of thermal expansion, and allows for automated and/or uniform assembly.

Top plate 30 may include a generally planar member 32 having a plurality of ports 33 extending therethrough through which fuel such as natural gas or propane may be discharged resulting in a desired flame picture or pattern. Top plate 30 may be initially formed and cut out from a flat planar member. Thereafter, the plurality of ports 33 may be drilled or stamped therethrough, a plurality of spaced-apart slots 34 adjacent to a peripherally-extending edge 36 cut or punched therethrough, a rounded notch 38 removed, and the corners between the adjacent sides of the flat planar member notched or removed. Next, the peripherally-extending edge may be bent downwardly to form a downwardly-depending, peripheral edge 39 having the plurality of space-apart slots 34 disposed therein as shown in FIG. 2. The top plate may be formed from stainless steel and coated with a high temperature black paint.

Gasket 40 generally includes a planar member 42 having a central cutout and a peripheral edge sized and configured for being received along the bottom surface of top plate 30 adjacent to downwardly-depending, peripheral edge 39. The gasket may be formed from a fiberglass material such as 1200 MANNIGLASS insulator available from Lydall Industrial Thermal Solutions of Hartford Connecticut or formed from other suitable materials.

Bottom base 50 includes a generally flat central portion 52 having an opening 54 for receiving a flow of fuel, and a peripheral edge or raised lip 58 which is sized and configured for being received along the bottom surface of top plate 30 adjacent to downwardly-depending, peripheral edge 39 with gasket 30 disposed therebetween. The raised lip forms a chamber within the gas burner assembly for distributing the gas and air mixture to the ports. The bottom base may be may be formed from cast iron.

Venturi tube assembly 60 includes a venturi tube 62 and a cap 64 which is attached to an end of venturi tube 62 to define a first aperture 66 for receiving a flow of fuel and a pair of second apertures 68 for receiving a flow of air for mixing with the flow of fuel. Tube holder 70 is attached to bottom base 50 using screws 72 receivable within threaded apertures (not shown). The venturi tube and cap may be formed from aluminum, and the tube holder may be formed from cast iron.

Figure 3:
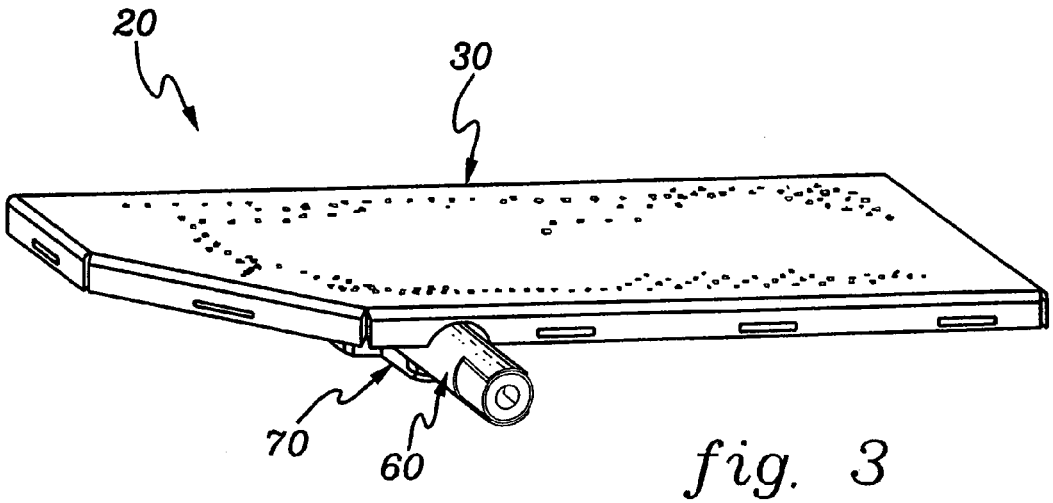
FIG. 3 is a perspective view of the assembled gas burner assembly of FIG. 2 prior to attachment of the top plate to the bottom base.

FIG. 3 illustrates assembled gas burner assembly 20 prior to securing top plate 30 to the bottom base. For example, venturi tube assembly 60 may be attached to the bottom base with tube holder 70 using the screws, and thereafter, the bottom base may be nested in top plate 30 with the gasket sandwiched therebetween.

Figure 4:
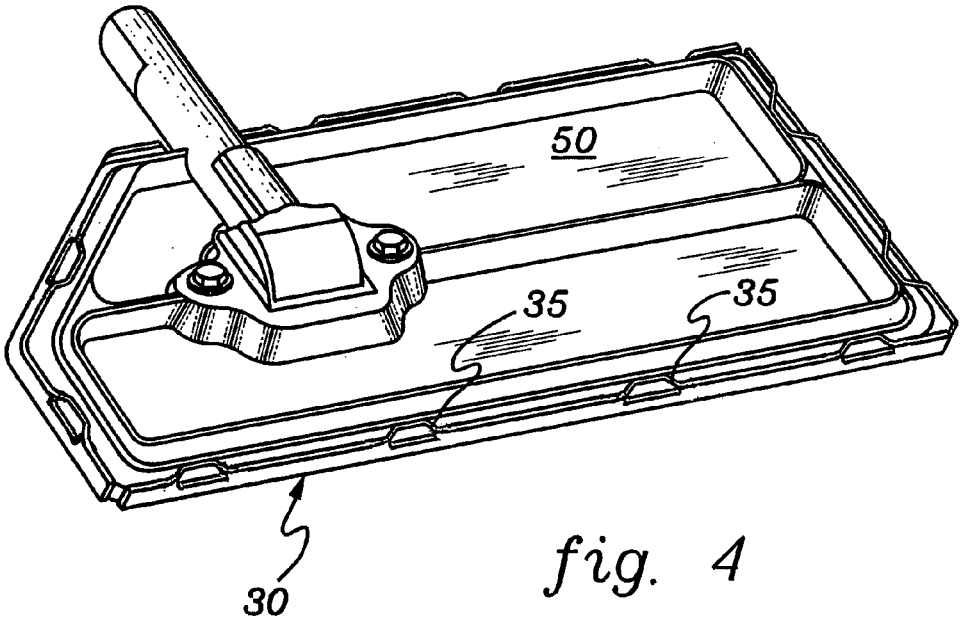
FIG. 4 is a perspective view of the bottom of the assembled gas burner assembly of FIG. 3 with the top plate attached to the bottom base.
Figure 5:
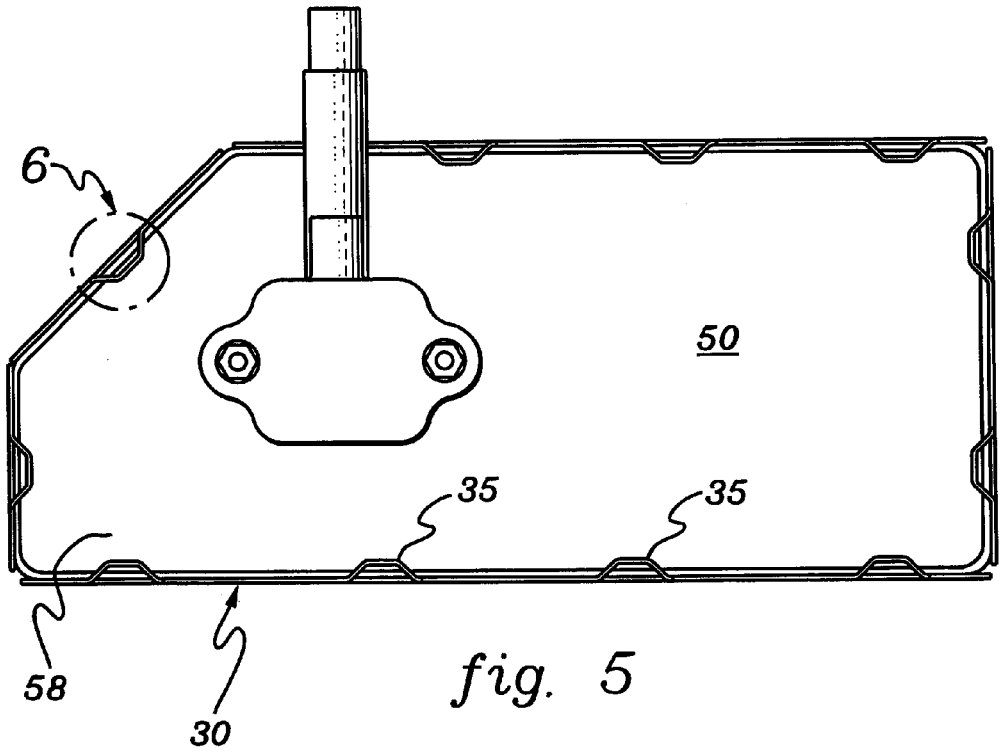
FIG. 5 is a bottom view of the assembled gas burner assembly of FIG. 4 with the top plate attached to the bottom base.
Figure 6:
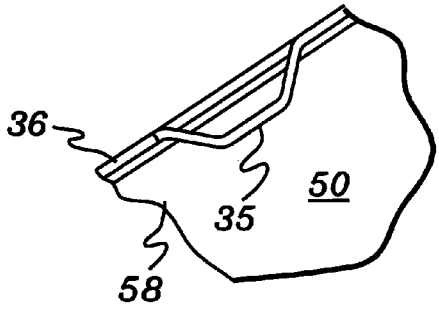
FIG. 6 is an enlarged view of detail 6 of FIG. 5 illustrating the attachment means for attaching the top plate to the bottom base.

As shown in FIGS. 4 and 5, thereafter a suitable number of tabs 35 may be formed in top plate 30 to securely and sealably attach top plate 30 to bottom base 50. As best shown in FIG. 6, a portion of the downwardly-depending, peripheral edge under the slot is displaced or extended to form an inwardly-extending tab 35 disposed under peripheral edge 58 of bottom base 50 to sandwich the edge or lip 58 of bottom base 50 and the gasket between the plurality of tabs and the bottom surface of top plate 50. The slot in the edge of the top plate is desirably positioned from the distal most edge of the top plate so that the various components may be compressed and/or sandwiched while the tab is formed resulting in the gasket remaining compressed between the top plate and the bottom base. For example, desirably, the gasket is resilient and may be deformed upon assembly to form a gas tight seal between the top plate and the bottom base.

For example, the portion of the downwardly-depending, peripheral edge under the horizontally-extending slot may be deformed or expanded to form inwardly-extending tab 35. The plurality of inwardly-extending tabs 35 may include a plurality of spaced-apart, generally inwardly extending V-shaped tabs, or a plurality of spaced-apart, generally inwardly-extending trapezoidally-shaped tabs. From the present description, other configurations of the tabs, such as square, rectangular, curved, cut, other configurations, and combinations thereof, may be suitably employed. In addition, the portion of the downwardly-depending, peripheral edge under the slot may be twisted, e.g., the lowermost middle section may be forced downwardly toward the bottom base.

In addition, the distance between adjacent slots may be greater than the length of the slots, and a suitable number of tabs may be formed to provide a gas tight seal with or without a gasket.

The tabs may be manually formed. Alternatively, the tabs may be formed using a hydraulically operated device having a tool such as jaws conforming to the shape of the tab and operable to apply a constant force for uniformly forming the tabs.

Figure 7:
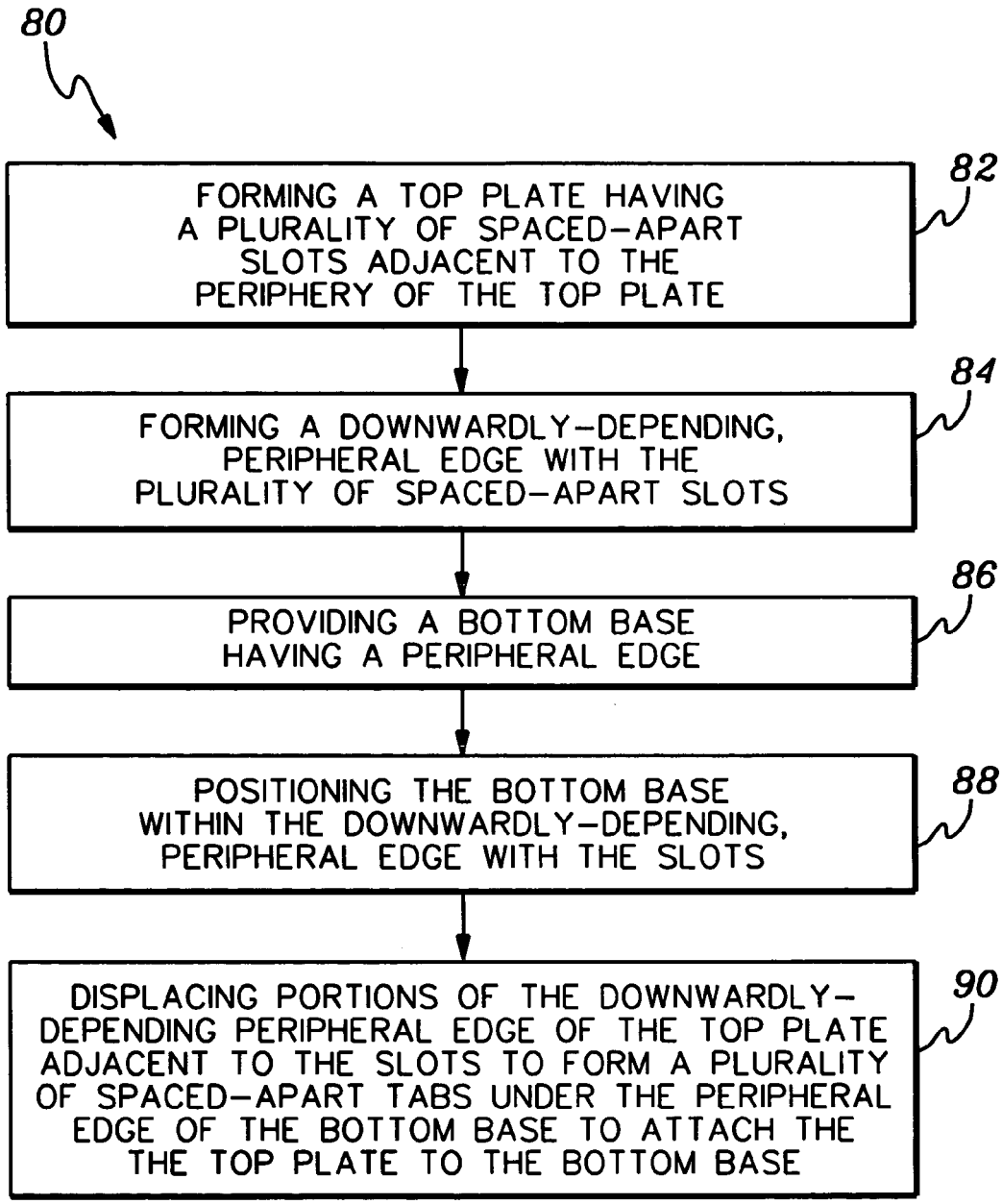
FIG. 7 is a flowchart of a method of assembling a gas burner assembly in accordance with the present invention.

As illustrated in FIG. 7, a method 80 for assembling a gas burner assembly may be represent by the steps of forming a top plate having a plurality of spaced-apart slots adjacent to the periphery of the top plate, at 82, and forming a downwardly-depending, peripheral edge with the spaced-apart slots, at 84. At 86, a bottom base having a peripheral edge is provided, and at 88, the bottom base is positioned within the downwardly-depending, peripheral edge with the slots.

Thereafter, at 90, portions of the downwardly-depending, peripheral edge of the top plate are displaced or extended to form a plurality of spaced-apart tabs under the peripheral edge of the bottom base to attach the top plate to the bottom base. Desirably, the components are pressed together prior to and during the forming of the tabs.

Further, the attachment technique of the present invention may be used on applications which require the attachment of a first member to a second member. For example, the first member may have a downwardly depending, peripheral edge having horizontally- and/or vertically-extending slots which allow a portion of the downwardly depending, peripheral edge to be displaced and/or expanded under a peripheral edge of the second member. This technique is desirably suitable where the first member and the second member have different thermal properties such as thermal expansion rates. The distance between adjacent slots may be greater than the length of the slots, and a suitable number of tabs may be formed to provide a gas tight seal with or without a gasket.

Figure 8:
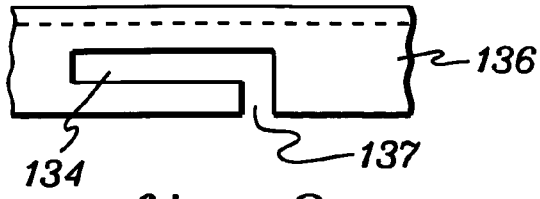
FIGS. 8 and 9 illustrate another embodiment of an attachment means in accordance with the present invention.
Figure 9:
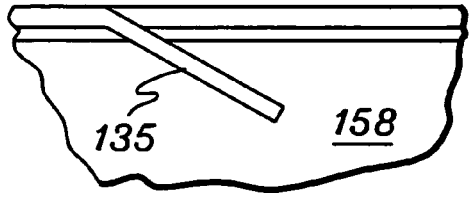

FIGS. 8–13 illustrate alternative embodiments of the present invention for use in a burner assembly and/or connecting a first member to a second member. For example, FIG. 8 illustrates a downwardly-depending peripheral edge 136 having a horizontally-extending slot 134 and a vertically-extending slot 137 connected to one end of horizontally-extending slot 134. As shown in FIG. 9, a portion 135 of the downwardly-depending peripheral edge can be displaced or bent inwardly under a second member 158.

Figure 10:
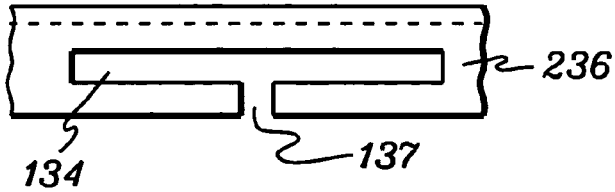
FIGS. 10 and 11 illustrate another embodiment of an attachment means in accordance with the present invention.
Figure 11:
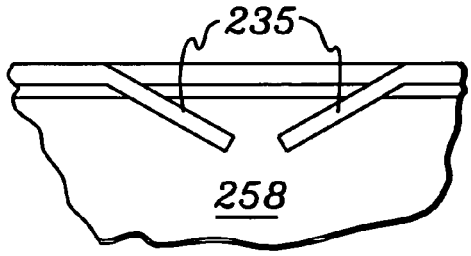

FIGS. 10 and 11 illustrates a downwardly-depending peripheral edge 236 having a horizontally-extending slot 134 and a vertically-extending slot 137 connected to the middle of horizontally-extending slot 134. As shown in FIG. 11, portions 235 of the downwardly-depending peripheral edge can be displaced or bent inwardly under a second member 258.

Figure 12:
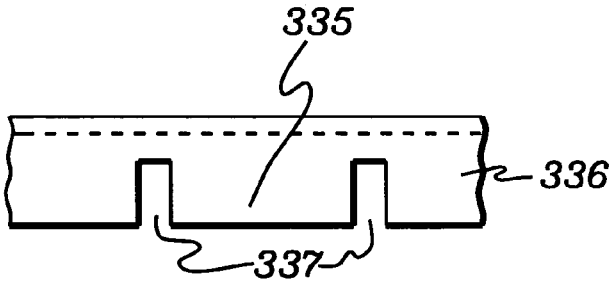
FIGS. 12 and 13 illustrate another embodiment of an attachment means in accordance with the present invention.
Figure 13:
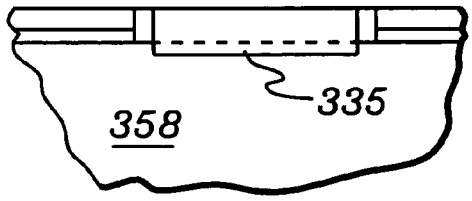

FIGS. 12 and 13 illustrates a downwardly-depending peripheral edge 336 having a pair of vertically-extending slots 337. As shown in FIG. 13, a portion 335 of the downwardly-depending peripheral edge can be displaced or bent inwardly under a second member 358.

From the present description, it will be appreciated by those skilled in the art that first member may have a plurality of spaced-apart individual vertically-extending slots employed to form the tabs. One or more of the vertical edges may be displaced or extended over or under the second member, e.g., by being bent on a 45-degree angle.

Furthermore, the location, size and/or configuration of the slots may vary so that when the various components are assembled, an interference type fit connection will occur along the engaging surface portion of the slot and the bottom base.

The attachment technique of the present invention utilizing tabs also allows for independent rates of expansion to occur between the top plate and the bottom base, thereby effectively eliminating thermal stresses that could result in deformation of the various materials and reduced service life of the gas burner assembly compared to conventional techniques for attaching the top plate to the bottom base of the gas burner assembly. With dissimilar materials such as dissimilar materials having different rates of thermal expansion, the attachment technique results in generally self adjusting pressure between the top plate, the gasket, and the bottom base. In addition, the present invention provides a generally fastener-less and tool-less assembly process which eliminates the need for drilling and tapping holes in the base, and drilling holes in the top plate while providing a structurally reliable assembled gas burner assembly. Thus, the gas burner assembly may be readily assembled without the use of conventional fasteners such as bolts. The technique for assembling the gas burner assembly may also be automated for a uniform assembly compared to manual hand assembly of attaching bolts.

While the gas burner assembly of the present invention has been described in connection with use in gas fired appliances such as vented gas fireplace heaters, it will be appreciated that the gas burner assemblies may also be used in barbeques, outdoor and indoor gas cooking grills, gas furnaces, gas boilers, gas fireplaces, gas fired space heating appliances, and other applications requiring a gas burner assembly.

Thus, while various embodiments of the present invention have been shown and described, it will be appreciated by those skilled in the art that many changes and modifications may be made thereunto without departing from the spirit and scope of the invention.

The invention claimed is:

1. A gas burner assembly comprising:

a gas burner having:

a top plate comprising stainless steel and having at least one port for discharging fuel and a perpendicular, peripheral edge having a plurality of horizontally-extending spaced-apart open slots;

a bottom base having a peripheral edge disposed within said peripheral edge of said top plate; and wherein said bottom base being attached to said top plate by plastically-deformed portions under said slots of said peripheral edge of said top plate forming a plurality of spaced-apart, inwardly-extending hollow tabs disposed under said peripheral edge of said bottom base.

2. The gas burner assembly of claim 1 wherein said plurality of inwardly-extending tabs comprises a plurality of spaced-apart, generally inwardly extending V-shaped tabs.

3. The gas burner assembly of claim 1 wherein said plurality of spaced-apart tabs are operable to maintain a gas tight seal between said top plate and said bottom base.

4. The gas burner assembly of claim 1 further comprising a gasket disposed between said bottom base and said top plate.

5. The gas burner assembly of claim 1 wherein a distance between adjacent slots are greater than a length of said slots.

6. The gas burner assembly of claim 1 further comprising a venturi tube assembly attached to said bottom base with a tube holder.

7. A gas fired appliance comprising:

a housing, and a gas burner assembly of claim 1 disposed in said housing.

8. The gas fired appliance of claim 7 further comprising at least one ceramic log disposed above said gas burner assembly.

9. The gas burner assembly of claim 1 wherein said bottom base comprises a different rate of thermal expansion from said top plate.

10. The gas burner assembly of claim 1 wherein said bottom base comprises cast iron.

11. The gas burner assembly of claim 10 wherein said plurality of inwardly-extending tabs comprises a plurality of spaced-apart, generally inwardly extending V-shaped tabs.

12. The gas burner assembly of claim 10 wherein said plurality of spaced-apart tabs are operable to maintain a gas tight seal between said top plate and said bottom base.

13. The gas burner assembly of claim 10 further comprising a gasket disposed between said bottom base and said top plate.

14. The gas burner assembly of claim 10 wherein a distance between adjacent slots are greater than a length of said slots.

15. The gas burner assembly of claim 10 further comprising a venturi tube assembly attached to said bottom base with a tube holder.

16. A gas fired appliance comprising a housing, and a gas burner assembly of claim 10 disposed in said housing.

17. The gas fired appliance of claim 16 further comprising at least one ceramic log disposed above said gas burner assembly.

18. A gas burner assembly comprising:

a gas burner having:

a top plate comprising stainless steel and having at least one port for discharging fuel and a perpendicular peripheral edge having a plurality of horizontally-extending spaced-apart open slots;

a bottom base having a peripheral edge disposed within said peripheral edge of said top plate;

a gasket disposed between said bottom base and said top plate;

a venturi tube assembly;

a tube holder for attaching said venture tube assembly to said bottom base; and wherein a distance between adjacent slots are greater than a length of said slots;

said bottom base being attached to said top plate by plastically-deformed portions under said slots of said peripheral edge of said top plate forming a plurality of spaced-apart, inwardly-extending hollow tabs disposed under said peripheral edge of said bottom base; and said gasket and said bottom base are sandwiched between a bottom surface of said top plate and said tabs and operable to maintain a gas tight seal between said top plate, said bottom base, and said gasket.

19. The gas burner assembly of claim 18 wherein said plurality of inwardly-extending tabs comprises a plurality of spaced-apart, generally inwardly extending V-shaped tabs.

20. A gas fired appliance comprising a housing, and a gas burner assembly of claim 18 disposed in said housing.

21. The gas fired appliance of claim 20 further comprising at least one ceramic log disposed above said gas burner assembly.

22. The gas burner assembly of claim 18 wherein said bottom base comprises a different rate of thermal expansion from said top plate.

23. The gas burner assembly of claim 18 wherein said bottom base comprises cast iron.

24. The gas burner assembly of claim 23 wherein said plurality of inwardly-extending tabs comprises a plurality of spaced-apart, generally inwardly extending V-shaped tabs.

25. A gas fired appliance comprising a housing, and a gas burner assembly of claim 23 disposed in said housing.

26. The gas fired appliance of claim 25 further comprising at least one ceramic log disposed above said gas burner assembly.

27. A method for assembling a gas burner assembly, the method comprising:

positioning a bottom base having a peripheral edge within a top plate comprising stainless steel and having at least one port and having a perpendicular peripheral edge with horizontally-extending spaced-apart open slots adjacent to the periphery of the top plate; and plastically-deforming portions under the slots of the peripheral edge of the top plate to form a plurality of spaced-apart hollow tabs under the peripheral edge of the bottom base to attach the top plate to the bottom base.

28. The method of claim 27 wherein the plastically-deforming comprises forming a plurality of spaced-apart, generally inwardly extending V-shaped tabs.

29. The method of claim 27 further comprising forming a gas tight seal between the top plate and the bottom base.

30. The method of claim 29 further comprising positioning a gasket between the top plate and the bottom base.

31. The method of claim 27 wherein the bottom base comprises a different rate of thermal expansion from the top plate.

32. The method of claim 27 wherein the bottom base comprises cast iron.

33. The method of claim 32 wherein the plastically-deforming comprises forming a plurality of spaced-apart, generally inwardly extending V-shaped tabs.

34. The method of claim 32 further comprising forming a gas tight seal between the top plate and the bottom base.

35. The method of claim 34 further comprising positioning a gasket between the top plate and the bottom base.

* * * * *